US007600888B1

(12) United States Patent
Miller

(10) Patent No.: US 7,600,888 B1
(45) Date of Patent: Oct. 13, 2009

(54) WIDE ANGLE DISPLAY LIGHTING SYSTEM

(75) Inventor: Michael R. Miller, Tupelo, MS (US)

(73) Assignee: Genlyte Thomas Group LLC, Louisville, KY (US)

( * ) Notice: Subject to any disclaimer, the term of this patent is extended or adjusted under 35 U.S.C. 154(b) by 76 days.

(21) Appl. No.: 11/075,176

(22) Filed: Mar. 8, 2005

(51) Int. Cl.
*F21S 8/00* (2006.01)

(52) U.S. Cl. ..... 362/225; 362/217.05; 362/217.08; 362/217.17; 362/410; 362/249.01

(58) Field of Classification Search ..... 362/225, 362/221, 249, 260, 346, 370, 410, 133, 217.05, 362/217.08, 217.14, 217.17
See application file for complete search history.

(56) References Cited

U.S. PATENT DOCUMENTS

| | | | | |
|---|---|---|---|---|
| 1,977,029 | A | 10/1934 | Welch | |
| 2,322,426 | A | 6/1943 | Dreyfuss | |
| 2,827,555 | A | 3/1958 | Woolley | |
| 3,077,536 | A | 2/1963 | Garnett | |
| 3,989,335 | A * | 11/1976 | Belokin, Jr. | 439/225 |
| 4,204,274 | A | 5/1980 | Luderitz | |
| 4,300,185 | A | 11/1981 | Wakamatsu | |
| 4,308,573 | A | 12/1981 | McNamara, Jr. | |
| 4,414,609 | A | 11/1983 | Shemitz | |
| 4,450,513 | A | 5/1984 | Guggemos | |
| 4,562,515 | A | 12/1985 | Lautzenheiser | |
| 4,849,864 | A | 7/1989 | Forrest | |
| 5,038,254 | A | 8/1991 | Fabbri et al. | |
| 5,075,827 | A * | 12/1991 | Smith | 362/221 |
| 5,086,375 | A | 2/1992 | Fabbri et al. | |
| 5,160,193 | A | 11/1992 | Fabbri et al. | |
| 5,272,608 | A | 12/1993 | Engle | |
| 5,289,357 | A | 2/1994 | Fabbri | |
| 5,343,373 | A | 8/1994 | Tillotson | |
| 5,727,870 | A | 3/1998 | Grierson | |
| 5,902,034 | A | 5/1999 | Santosuosso et al. | |
| 5,921,666 | A | 7/1999 | Preston et al. | |
| 6,170,962 | B1 * | 1/2001 | Wordin | 362/247 |
| 6,174,069 | B1 | 1/2001 | Plunk et al. | |
| 6,270,232 | B1 | 8/2001 | Shemitz et al. | |
| 6,402,345 | B1 | 6/2002 | Fishman | |
| 6,422,721 | B1 | 7/2002 | Plunk et al. | |
| 6,431,721 | B2 | 8/2002 | Shemitz et al. | |
| 6,505,953 | B1 | 1/2003 | Dahlen | |
| 6,558,017 | B1 | 5/2003 | Saraiji et al. | |
| 6,652,119 | B1 * | 11/2003 | Barton | 362/225 |
| 6,733,154 | B1 | 5/2004 | Dahlen | |
| 6,746,325 | B2 | 6/2004 | Crane | |
| 6,753,429 | B2 | 6/2004 | Theodoridis et al. | |
| 6,776,509 | B1 | 8/2004 | Warner | |

(Continued)

FOREIGN PATENT DOCUMENTS

DE 1489472 B * 10/1976

(Continued)

*Primary Examiner*—Sharon E Payne
(74) *Attorney, Agent, or Firm*—Middleton & Reutlinger; John F. Salazar

(57) ABSTRACT

A display lighting system for use in product displays includes a luminaire having a pair of spaced opposed end caps, and a lamp housing having a plurality of lamp holders secured thereto for providing electrical power to a plurality of lamps designed to illuminate a plurality of lighting areas.

15 Claims, 5 Drawing Sheets

U.S. PATENT DOCUMENTS

| | | | |
|---|---|---|---|
| 6,808,285 | B2 | 10/2004 | Shemitz et al. |
| 6,827,465 | B2 | 12/2004 | Shemitz et al. |
| 6,837,592 | B1 | 1/2005 | Dahlen |
| 7,229,191 | B1 | 6/2007 | Plunk et al. |

FOREIGN PATENT DOCUMENTS

| | | | |
|---|---|---|---|
| JP | 04307008 | A * | 10/1992 |

* cited by examiner

WIDE ANGLE DISPLAY LIGHTING SYSTEM

BACKGROUND OF THE INVENTION

1. Field of the Invention

The present invention relates generally to lighting systems utilized in product display applications and more specifically to a lighting system incorporating a luminaire having a plurality of lamps for illuminating a plurality of target lighting areas.

2. Description of the Related Art

Many known display lighting systems employ lighting units that are placed above or below the objects they are intended to illuminate, typically held in place by a fixture or fixtures. These systems are typically adapted to be secured to a conventional product gondola, for example supermarket shelving, having a number of spaced uprights connected by horizontal shelving onto which products are placed. In such a system, the uprights generally include a plurality of slots in which shelving tabs are inserted, and also into which pairs of arms are inserted to secure the lighting systems outwardly from the uprights to provide illumination for the shelving. Many of these systems include a light source or lamp, a ballast, reflectors, lamp holders, and connectors for fastening the various components of the system together.

These prior art display lighting systems are typically placed above a plurality of product shelves to illuminate the products situated below. Luminaires are spaced outwardly from the product shelves by spaced arms in order to efficiently illuminate the displayed products. One disadvantage of these known systems is the difficulty of installation of new luminaries given their complex design and difficulty in routing wiring to a plurality of luminaires. Accordingly, access to wiring is often cumbersome, since the wiring must be routed from a source point, out one of the arms, and into the luminaire.

Additionally, prior art systems are unable to illuminate products in more than one lighting zone or target area utilizing a single luminaire. This problem can be overcome by mounting a plurality of luminaires in close proximity, thereby permitting the illumination of multiple zones. However, it is typically difficult to arrange these prior art systems to illuminate multiple lighting areas, without the placement of the luminaires being obtrusive to patrons. Additionally, the complexity of the wiring required to supply power to the luminaires increases greatly when additional luminaires are required for a display, thereby increasing attendant costs for labor and material.

Some prior art systems have also included various mechanisms whereby the mounting angle of a luminaire may be varied to cast light at alternative angles, depending upon the placement of products in the display. One difficulty with this system is that where a store has a great number of similarly situated product gondolas, each luminaire in the system must be identically adjusted to prevent the lighting system from looking haphazard. In other words, unless the light patterns cast by the luminaires are essentially the same, the system looks "sloppy". This difficulty can only be overcome by manually setting each luminaire to the identical position, which of course requires a great deal of labor in large stores.

SUMMARY OF THE INVENTION

The present invention overcomes the aforementioned disadvantages by providing a display lighting system having a single luminaire that includes multiple light sources that may be arranged to provide illumination to separate lighting areas or zones. The system of the instant invention comprises a luminaire that includes a pair of end caps having an aperture therein to enable an installer to route wiring from adjacently positioned luminaires. The end caps are secured to a lamp housing at either end thereof that is shaped to hold a plurality of lamps at various angles with respect to target illumination areas.

Additionally, one or both of the end caps may include a recessed portion therein disposed on the side of the end cap oriented away from the lamp housing that engages an arm depending from a product shelf upright, in order to positively position the luminaire at an advantageous angle to the target illumination areas. In applications wherein conventional fluorescent lamps are employed, a ballast or transformer may be secured within the lamp housing to provide sufficient electrical power necessary for starting the lamps.

The system of the present invention may further comprise a nipple or grommet disposed in the aperture of the end caps to permit wiring to be easily passed therethrough to an adjacent fixture, and further to prevent damage to the wiring insulation. The lamp housing may incorporate a plurality of dividers, to separate lamps intended to illuminate distinct target areas. Furthermore, reflectors may be secured to the dividers to reflect illumination towards its intended target area.

Further objects, features and advantages of the present invention will become apparent from the detailed description of the preferred embodiments taken in conjunction with the drawing Figures herein below.

BRIEF DESCRIPTION OF THE DRAWING FIGURES

DETAILED DESCRIPTION OF THE PREFERRED EMBODIMENT(S)

Figure 1:
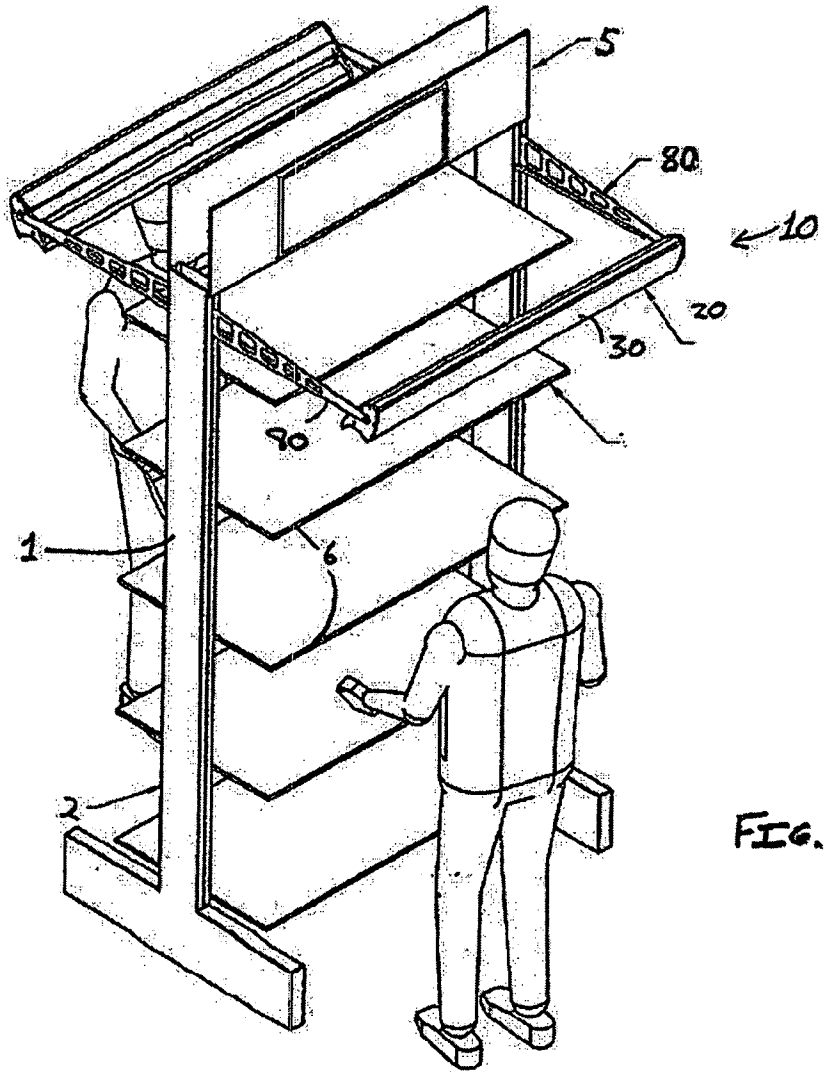
FIG. 1 is an isometric diagram of a luminaire installed in a product display environment in accordance with one embodiment of the present invention.

Referring now to FIG. 1, and in accordance with a constructed embodiment of the present invention, a display lighting system 10 comprises a luminaire 20 including a lamp housing 30 having first and second ends 32 and a pair of spaced end caps 60 that are secured to lamp housing 30 at first and second ends 32 respectively. Lamp housing 30 has a plurality of lamp holders 34 secured thereto the at a plurality of points to hold lamps in a fixed position relative to the housing 30 and electrically connect them to conductors delivering electrical power.

Lamp holders 34 may be provided for a variety of lamp types and sizes, for example a T-5 fluorescent lamp that is commonly used in display lighting systems. Lamp holders 34 may be secured at a plurality of positions to lamp housing 30, as required to accommodate individual lamp sizes and illumination areas. While this specification refers primarily to fluorescent lamps used in conjunction with the present invention, one of ordinary skill in the art will appreciate that a wide variety of lamps may be employed including but not limited to incandescent, halogen, quartz and light emitting diodes.

The end caps 60 have an aperture 62 therein for routing electrical conductors therethrough, and may include a plurality of fastener holes 64 to enable end caps 60 to be secured to lamp housing 30 with a plurality of conventional fasteners such as screws or rivets. End caps 60 may also be fitted with a close nipple or grommet 66 to provide additional protection to wiring passing therethrough. In accordance with one embodiment of the present invention, best seen in FIGS. 4 and 5, at least one end cap 60 further includes a recessed portion 68 shaped to be engaged by a support arm 80 first end 82 to positively fix the mounting angle of the luminaire 20 with respect to the target areas to be illuminated. This feature of the present invention permits quick and simple installation of the luminaire 20 while maintaining an optimal illumination angle for target areas, depending upon the length of support arms 80. The position of the recessed portion 68 on end cap 60 may be altered to provide an optimized illumination for a product display based on a given support arm 80 length and shape.

Figure 2:
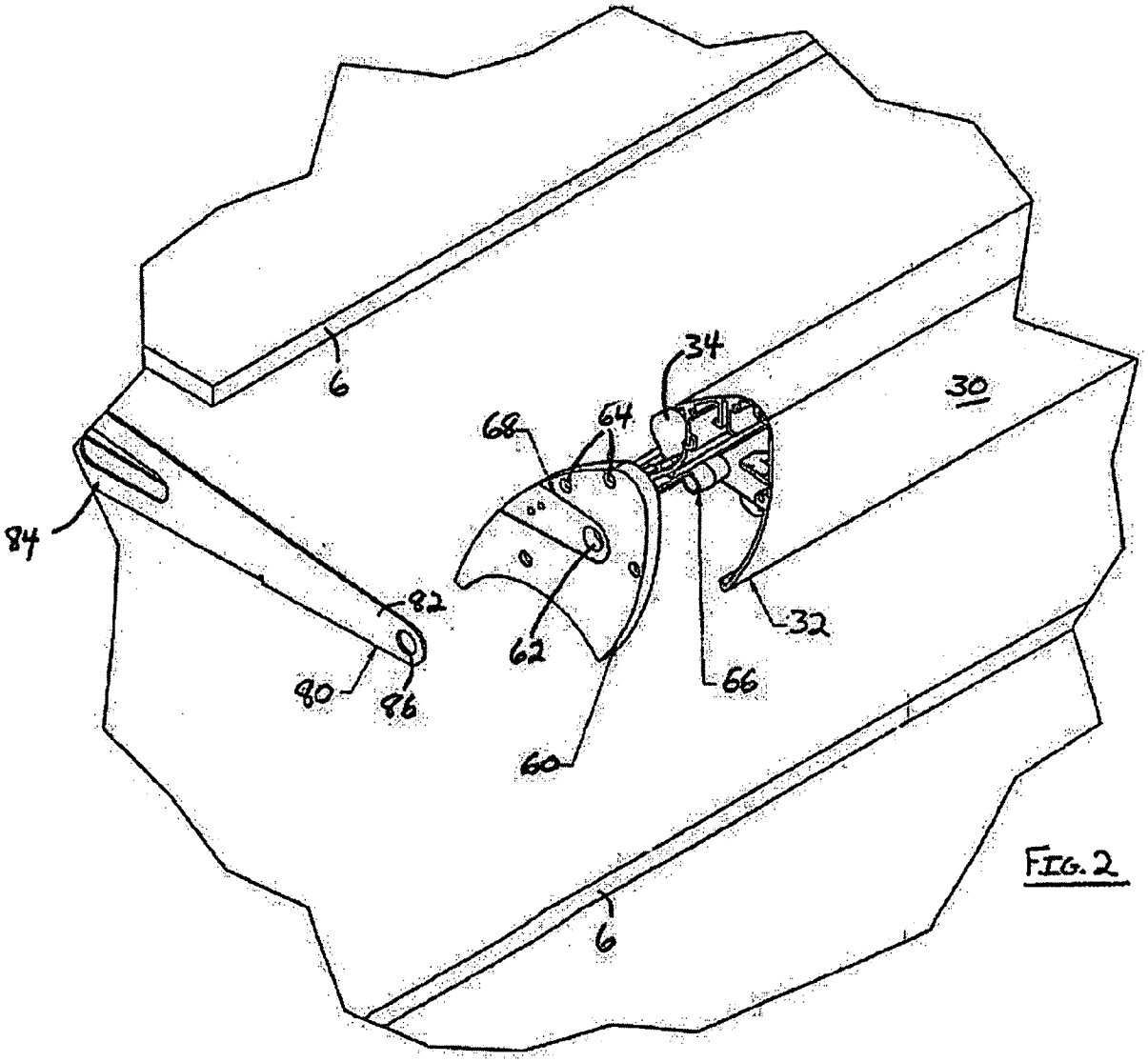
FIG. 2 is an isometric exploded view of a display lighting system in accordance with one embodiment of the present invention.
Figure 3:
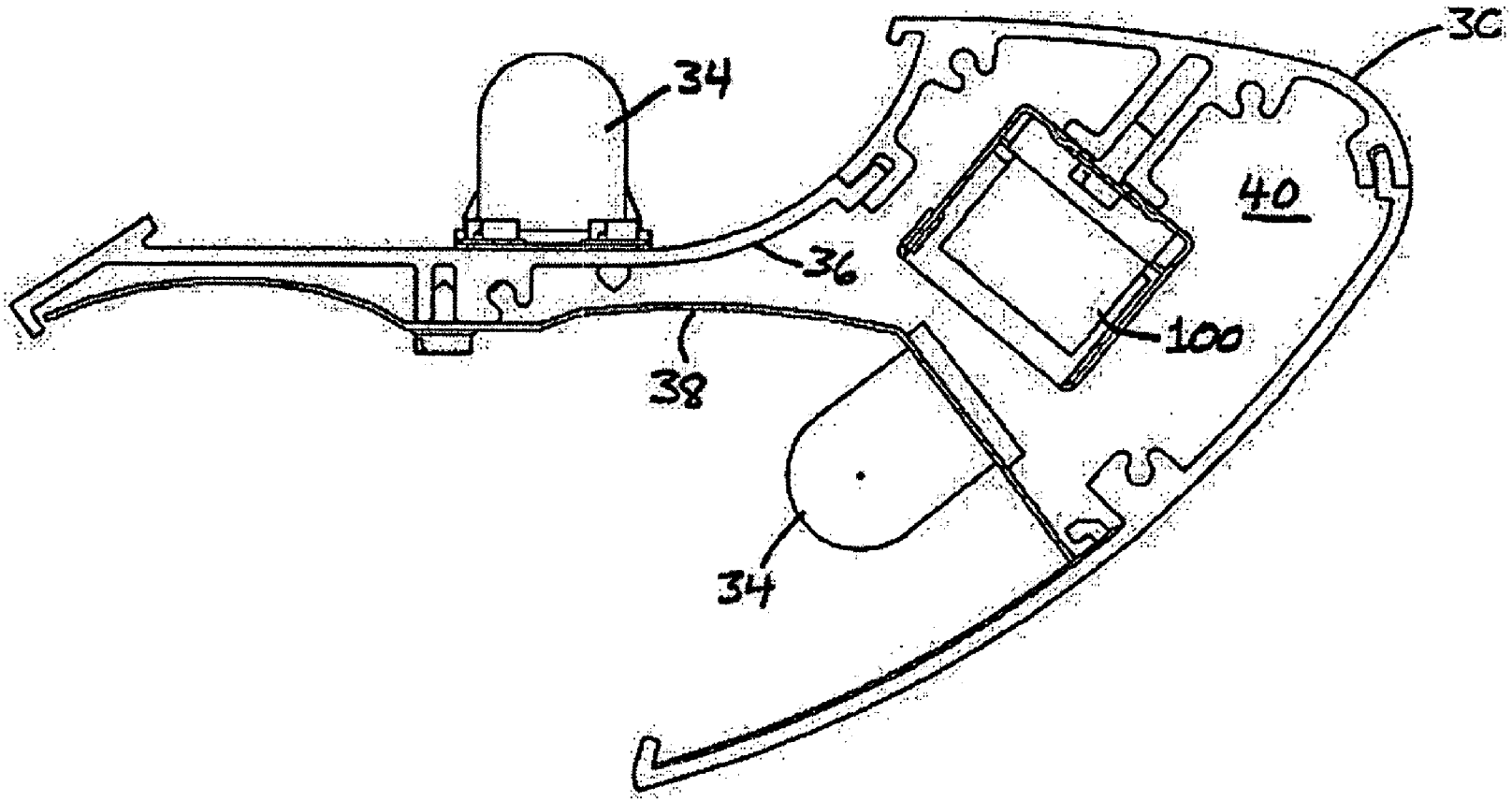
FIG. 3 is a cross-sectional view of a luminaire in accordance with one embodiment of the present invention.

As best seen in FIGS. 1 and 2, a spaced pair of support arms 80 may be secured to end caps 60 at a first end 82 by conventional fasteners or screws. The support arms 80 may have an aperture 86 therein that is generally concentric with aperture 62 of end cap 60 such that wiring may be passed through both apertures. This feature of the present invention is particularly advantageous where a plurality of luminaires 20 are disposed adjacent each other, since the power wiring may be routed easily from one luminaire 20 to the next. Support arms 80 may be secured at a second end 84 to a plurality of conventional uprights 1, shown in FIG. 1 as a component of a product gondola 2. Within the lamp housing 30 lamp holders 34 are secured such that, when installed, lamps are capable of illuminating a plurality of target lighting areas, for example product signage 5 and shelving 6.

Figure 5:
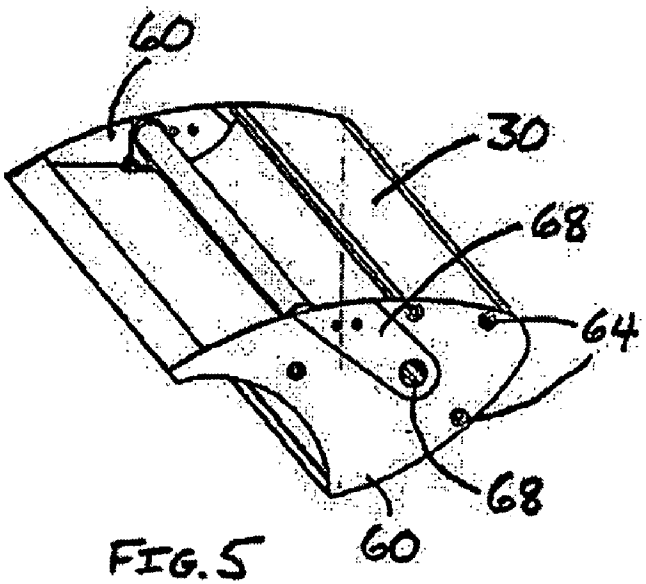
FIG. 5 is an isometric view of the top portion of a luminaire in accordance with one embodiment of the present invention.
Figure 4:
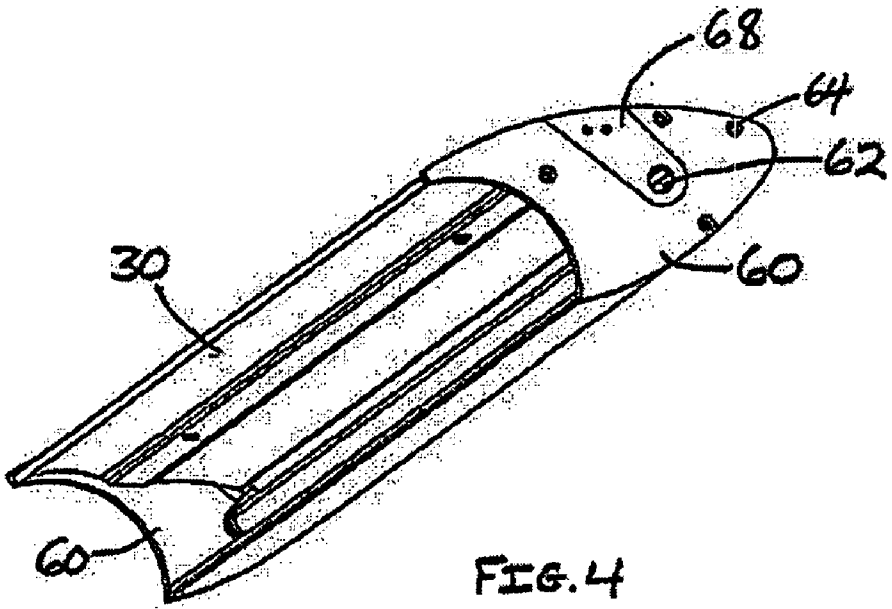
FIG. 4 is an isometric view of the bottom portion of a luminaire in accordance with one embodiment of the present invention.
Figure 6:
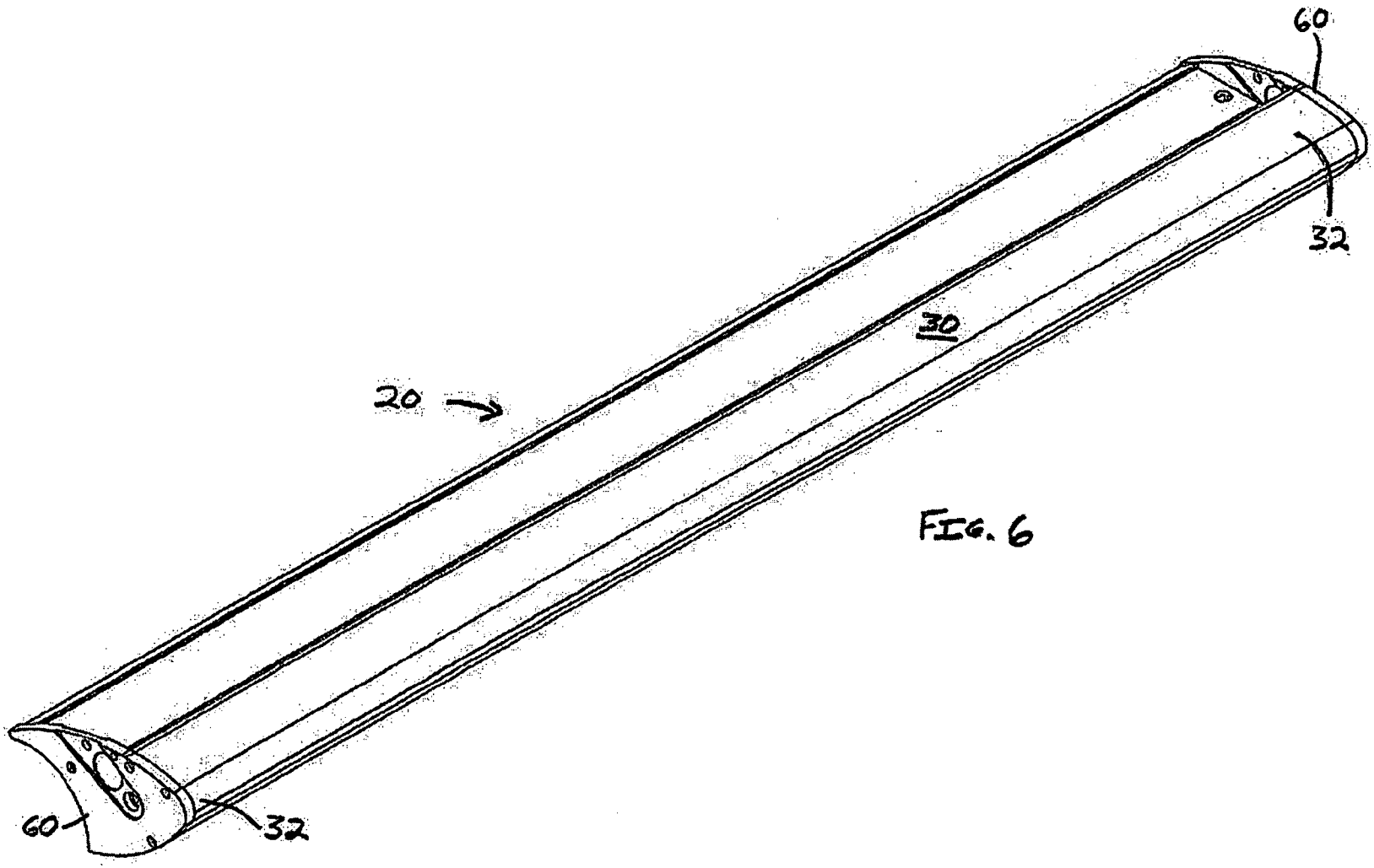
FIG. 6 is an isometric view of the top portion of a luminaire in accordance with one embodiment of the present invention.

As seen in FIGS. 1, 4, and 5, in one embodiment of the present invention two lamps 7 are installed within luminaire 20 housing 30. In this arrangement two pairs of lamp holders 34 (one pair for each fluorescent lamp) are separated by a divider 36 that extends substantially along the entire length of lamp housing 30, to assist in directing the illumination from each lamp to a target area. Furthermore, a reflector 38 may be installed within the lamp housing 30 to focus the illumination provided by a lamp to its target area.

In the two-lamp embodiment of the present invention discussed herein above, and as best seen in FIG. 1, one lamp may be positioned within lamp housing 30 to provide illumination to signage 5 above the vertical position of luminaire 20, while a second lamp provides illumination directed downwardly and inwardly to the product shelves 6 secured to gondola 2. Accordingly, the invention provides a simply installed display lighting system capable of illumination a plurality of lighting zones with a single luminaire. One of ordinary skill in the art will appreciate that a plurality of lamps may be secured within the lamp housing 30 at a plurality of locations to provide illumination for a plurality of target areas. This feature of the present invention also reduces the wiring required for a display lighting system, since a plurality of lamps may reside within a single luminaire 20.

In a yet further embodiment of the present invention, where it is desirable to use fluorescent lamps, a ballast 100, or alternatively a transformer, may be mounted within an interior portion 40 of lamp housing 30 and wired to lamp holders 34 to provide sufficient electrical starting power to the fluorescent lamps. This feature of the invention obviates the necessity for mounting a ballast at a point distant from the lamp, requiring additional wiring to be installed on site. Similarly, where direct current lamps are employed in the present invention, a DC transformer may be mounted in the interior portion 40 so that supply wiring need only be routed to the transformer during installation.

While the present invention has been shown and described herein in what are considered to be the preferred embodiments thereof, illustrating the results and advantages over the prior art obtained through the present invention, the invention is not limited to those specific embodiments. Thus, the forms of the invention shown and described herein are to be taken as illustrative only and other embodiments may be selected without departing from the scope of the present invention.

I claim:

1. A display lighting system for illuminating a shelving structure comprising:

a luminaire having a unitary lamp housing forming two linear lamp cavities along a central longitudinal axis between a pair of spaced opposed end caps, wherein a separate one of said end caps fully covers adjacent axial distal ends of said linear lamp cavities a pair of spaced arms each secured at a first end directly to said separate one of said end caps for positioning said display lighting system, wherein each of said spaced arms is positioned perpendicular to said central longitudinal axis of said linear lamp cavities each one of said end caps having a recess perpendicular to said central longitudinal axis and extending from only a portion of an outside edge of said end cap and across an outside surface of said end cap to a distance offset from said portion of said outside edge of said end cap whereby a remainder of said outside surface of said end cap remains laterally to the left and right of said recess, at least one of said recesses of said end caps having an aperture extending through from said recess to an inside surface of said end cap and substantially parallel to said central longitudinal axis of said linear lamp cavities for routing conductors therethrough and in electrical communication with a plurality of lamp holders, and said unitary lamp housing having said plurality of lamp holders secured between said pair of spaced opposed end caps for providing electrical power to a plurality of lamps, and for securing and positioning said lamps to illuminate from said two linear lamp cavities, one of said linear lamp cavities having at least one reflector secured thereto to reflect illumination from at least one of said plurality of lamps whereby one of said linear lamp cavities illuminates downwardly and inwardly towards a first target area and said other linear lamp cavity illuminates upwardly and inwardly towards a second target area, wherein said first target area is substantially exclusive from said second target area; and said recess of each one of said end caps directly receives said first end of said spaced arms to positively fix the mounting angle of said luminaire with respect to said first target area and said second target area since said remainder of said outside surface of each said end cap prevents rotation of said luminaire.

2. A display lighting system as claimed in claim 1 wherein said spaced arms are secured at a second end to an upright.

3. A display lighting system as claimed in claim 1 wherein said spaced arms include an aperture in said first end thereof, said aperture of said first end of said spaced arm being generally concentric with said aperture in said recess of said end cap.

4. A display lighting system as claimed in claim 1 further comprising a ballast mounted within an interior portion of said unitary lamp housing to provide starting electrical power to said lamps.

5. A display lighting system as claimed in claim 1 further comprising a transformer mounted within said unitary lamp housing to provide starting electrical power to said lamps.

6. A display lighting system as claimed in claim 1 wherein each of said end caps include a nipple disposed in said aperture of said recess of said end cap for routing said conductors from said luminaire to a similar adjacent luminaire, whereby said luminaire and said similar adjacent luminaire are axially aligned along said central longitudinal axis.

7. A display lighting system as claimed in claim 1 further comprising a plurality of fixed dividers between said lamp holders.

8. A first display lighting system capable of interconnecting to a similar second display lighting system for illuminating adjacent similar shelving structure comprising:

a first luminaire having a pair of spaced opposed end caps, each of said opposing end caps having a slotted recess on an outside surface thereof with an aperture extending through said slotted recess to an inside surface of said end cap for routing wiring therethrough, and a unitary lamp housing secured at first and second ends thereof to said end caps, said unitary lamp housing forming a first linear lamp cavity and a second linear lamp cavity, each adjacent axial ends of said first linear lamp cavity and said second linear lamp cavity fully covered by said end caps each of said first linear lamp cavity and said second linear lamp cavity having at least one lamp to illuminate two lighting areas substantially exclusive of each other, one said lighting area directed in an upwardly and inwardly direction and said other lighting area directed in a downwardly and inwardly direction; and a pair of support arms having a first end that is directly received into said slotted recesses of said end caps positively fixing the mounting angle of said first luminaire, each said first end of said support arms having a second aperture concentrically aligned with said aperture of said slotted recess of said end cap, whereby said concentrically aligned said aperture and said second aperture allowing said wiring of said first luminaire to electrically interconnect to an axially adjacent similar second luminaire.

9. A display lighting system as claimed in claim 8 wherein said unitary lamp housing includes a fixed divider between said first linear lamp cavity and said second linear lamp cavity.

10. A display lighting system as claimed in claim 8 wherein one of said linear lamp cavities includes a reflector for at least one said lamp to reflect illumination from said lamp to said lighting area.

11. A display lighting system as claimed in claim 8 wherein said pair of support arms of said first luminaire are secured at a second end to an upright.

12. A display lighting system as claimed in claim 8 wherein said at least one lamp is incandescent.

13. A display lighting system as claimed in claim 8 wherein said at least one lamp is fluorescent.

14. A display lighting system for illuminating a shelving structure comprising:

a luminaire having a pair of spaced opposed end caps and a unitary lamp housing forming two linear lamp cavities between said opposed end caps wherein said opposed end caps fully cover opposing adjacent axial ends of said two linear lamp cavities, each of said linear lamp cavities having a pair of lamp holders and a directional reflector, each of said end caps affixed directly to a support arm each having a first end and a second end, wherein each of said support arms is directly secured at said first end to a separate one of said end caps and said second end of said support arm is secured to said shelving structure, said first end of each of said support arms fixedly received into a substantially linear recess of an outer surface of said end cap that is substantially perpendicular to the axis of said two linear lamp cavities whereby preventing rotational or pivoting movement of said luminaire in relation to said support arms; and wherein one of said directional reflectors directs light downwardly and inwardly towards said shelving structure and said other directional reflector directs light upwardly and inwardly towards said shelving structure.

15. A display lighting system for illuminating towards a mounting structure comprising:

a luminaire having a pair of spaced opposed end caps and an elongated unitary lamp housing, wherein said opposed end caps are positioned to fully cover said opposing distal ends of said elongated unitary lamp housing wherein a first end of a support arm directly affixes to one of said opposed end caps and a second end of said support arm affixes to said mounting structure, said support arm spacing said luminaire away from said mounting structure, whereby said first end of said support arm is directly and rigidly received in an elongated recess within said end cap that is substantially perpendicular to the longitudinal axis of said elongated unitary lamp housing preventing rotation and pivoting of said luminaire relative to said mounting structure;

said elongated unitary lamp housing forming a first linear lamp cavity and a second linear lamp cavity, said first linear cavity having a first lamp and directs light downwardly and inwardly towards said mounting structure and said second linear lamp cavity having a second lamp and directs light upwardly and inwardly towards said mounting structure; and said first linear cavity and said second linear cavity is stationary relative to each other.

* * * * *